United States Patent [19]

Harris

[11] 4,337,716

[45] Jul. 6, 1982

[54] MARINE GROWTH WIPER

[76] Inventor: Jack Harris, 4460 ½ Utah St., San Diego, Calif. 92116

[21] Appl. No.: 780,749

[22] Filed: Mar. 24, 1977

[51] Int. Cl.[3] ..... B63B 59/00

[52] U.S. Cl. ..... 114/222

[58] Field of Search ..... 114/221 R, 222, 270, 114/67 R, 243, 242; 15/229 R, 246; 182/196, 198; 9/3, 4 R, 8 R, 11 R

[56] References Cited

U.S. PATENT DOCUMENTS

| | | | |
|---|---|---|---|
| 560,646 | 5/1896 | Reilly | 114/222 |
| 2,474,479 | 6/1949 | Justice | 9/11 R |
| 2,903,716 | 9/1959 | Zasada | 9/8 R |
| 2,991,489 | 7/1961 | Kubach | 9/4 R |
| 3,368,514 | 2/1968 | Kelly | 114/243 |
| 3,440,991 | 4/1969 | Cubbage | 114/243 |
| 3,571,819 | 3/1971 | Puncochar | 114/222 |
| 3,677,539 | 7/1972 | Bennet | 9/8 R |
| 3,752,109 | 8/1973 | Seiple | 114/222 |
| 3,793,663 | 2/1974 | Lieffring | 15/DIG. 2 |
| 3,813,717 | 6/1974 | Mousetis | 9/3 |
| 3,974,794 | 8/1976 | Kakitani et al. | 114/242 |
| 4,046,095 | 9/1977 | Fike | 114/222 |

OTHER PUBLICATIONS

The American Chain Ladder Co. Inc., pp. 1-3, (1943).

*Primary Examiner*—Trygve M. Blix
*Assistant Examiner*—Jesus D. Sotelo
*Attorney, Agent, or Firm*—Robert F. Beers; Ervin F. Johnston

[57] ABSTRACT

The invention is a marine growth wiper and method of wiping for a waterborne object. The wiper includes at least one cord and a device for positioning the cord so that the cord is located below the waterline and within wiping distance of a submerged surface area of the waterborne object. With this arrangement, any water movement will cause the cord portion to wipe across the submerged surface area to remove primary marine growth therefrom. The wiping action is enhanced by utilizing a plurality of the cords either spaced from one another with respect to the surface of the object or attached to the object at a common location. The cords may be either positively or negatively buoyant depending upon the manner of their positioning. The method includes providing a plurality of such cords, positioning the cords so that the cords will wipe across the object, and suspending the cords free in the water so that water movement will activate the cords to wipe across the object.

16 Claims, 11 Drawing Figures

MARINE GROWTH WIPER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

A long standing troublesome area in the art has been the build-up of marine growth on waterborne objects, such as ships, boats, buoys, and pilings, particularly in the ocean waters. Every two or three years the Navy schedules dry dock time for its ships so that, along with other repairs, the bottom of the ship can be scraped clean of marine growth. This marine growth accumulates while a ship is in port, and the problem manifests itself when the ship is underway. Marine growth can slow the cruising speed of a ship by 3 to 5 knots, which is tactically undesirable as well as consuming an excess amount of fuel.

The prior art discloses various apparatuses for cleaning the hulls of ships of their marine growth. A patent to Rogers, U.S. Pat. No. 883,423, discloses an array of cleaners which operate on the exterior of the hull while the ship is underway. These cleaners or scrapers are actuated by the movement of the ship through the water to remove the marine growth. A patent to Inglis, U.S. Pat. No. 622,232, utilizes a cleaning arrangement which is held stationary in the water while the ship moves therethrough. A patent to Quimby, U.S. Pat. No. 623,961, discloses a shroud for the hull of a ship so that a poisonous solution can be disseminated between the ship and the shroud for killing any marine growth. A patent to White, British Pat. No. 5514, discloses a cleaning system which is operated by personnel aboard the ship. These patents disclose marine growth cleaning devices which are not entirely satisfactory, because, once the marine growth is established, it is encrusted too hard to clean by such methods. Sometimes the paint on the hull of the ship is removed by such methods, which can't be replaced unless the ship is drydocked, and all of the methods require a significant amount of work.

The hulls of many ships, as well as other waterborne objects, are covered with an antifouling paint. This paint contains a toxin which is leached into the water slowly over a period of time to retard marine growth. Such paint is effective for up to two years, after which the old paint must be cleaned off and a new coat applied. Presently, there are some questions in regard to the wisdom in utilizing such paints since the toxins are obviously released into the ocean. Obviously, such antifouling paints are polluting in nature and are expensive to apply.

Acccordingly, there has been a long standing need for a simpler way of overcoming the problem of marine growth on waterborne objects, in particular ocean going ships and boats. In the history of man, literally billions of dollars have been expended in an attempt to overcome this problem.

SUMMARY OF THE INVENTION

The present invention is a device and method for overcoming the problem of marine growth on waterborne objects, such as ships, boats, buoys, and pilings, particularly in an ocean environment. The invention includes at least one cord, and a device for positioning the cord so that a portion of the cord is located below the waterline and within wiping distance of a submerged surface area of the waterborne object. With this arrangement water movement, such as tides, wave action, or currents, will cause the cord portion to wipe across the submerged surface area to remove primary marine growth therefrom. There are various embodiments of the invention, some of which suspend a plurality of positively buoyant cords below the object, and some of which attach a plurality of buoyant or negatively buoyant cords to the object at a common location. The method of the invention includes providing a plurality of buoyant cords, positioning the cords below the object so that the cords are capable of wiping across the bottom of the object, and suspending the cords free in the water so the water movement will activate the cords to wipe across the object. When no marine growth has been established the invention will prevent the commencement of any build up of marine growth, or if marine growth has already been established the invention will remove this growth and prevent any further growth on the object. The present invention is a very inexpensive solution to a long standing problem in the art.

STATEMENT OF THE OBJECTS OF THE INVENTION

An object of the present invention is to overcome the aforementioned problems associated with the removal of marine primary growth from waterborne objects.

Another object is to provide a nonpolluting apparatus for preventing the growth of marine organisms on a waterborne object, such as a ship, boat, buoy, or piling.

A further object is to provide an inexpensive apparatus for removing an established growth of marine organisms from a waterborne object, and after removal preventing the establishment of any further marine growth on such object.

Still another object is to provide an inexpensive method for removing and/or preventing the growth of marine organisms on a waterborne object.

These and other objects of the invention will become more readily apparent from the ensuing specification when taken together with the drawings.

DESCRIPTION OF THE PREFERRED EMBODIMENTS

Figure 1:
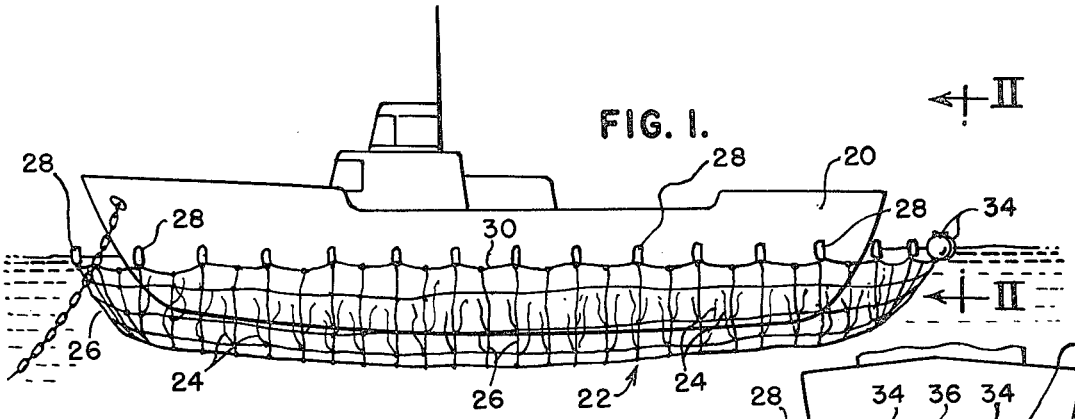
FIG. 1 is a side elevation view of a ship being protected from marine growth by one embodiment of the invention.

Referring now to the drawings, wherein like reference numerals designate like or similar parts throughout the several views there is illustrated in FIG. 1 a waterborne object, such as a ship 20, which is being protected from marine growth by a marine growth wiper apparatus 22. When the ship is still in the water, especially ocean water, marine growth will develop quickly on the hull portion of the ship at and below the waterline at a rate which is dependent upon the temperature of the water. The marine growth wiper apparatus 22 of the present invention prevents the commencement of any growth of marine organisms on the hull or, if marine growth has already been established, the wiper apparatus 22 will remove such growth and prevent the establishment of any further marine growth on the ship's hull.

The marine growth wiper apparatus 22 includes at least one limp cord, and preferably a plurality of such cords 24. The marine growth wiper apparatus 22 further includes means for positioning the cords 24 so that the cords are located below the waterline and within wiping distance of the submerged hull surface area of the ship 20.

Figure 2:
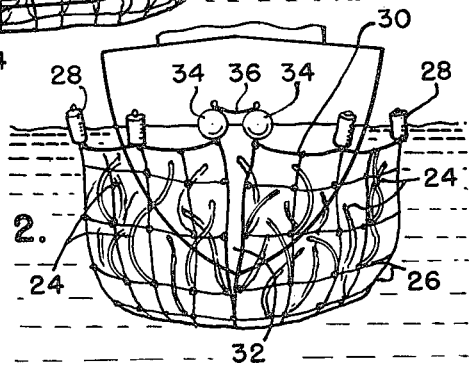
FIG. 2 is an ocean elevation view of the ship taken along plane II—II of FIG. 1.

In the embodiment of FIGS. 1 and 2 the positioning means may include a negatively buoyant underwater support, such as a net 26, which is suspended free in the water about the hull of the ship 20 by a plurality of floats 28. In this embodiment the cords 24 are positively buoyant so as to stream upwardly from the net 26 for wiping the bottom and side hull portions of the ship free of marine growth. It has been found that cords made of propylene which are approximately one-half inch in diameter work satisfactorily for this purpose, however, smaller or larger cords even up to rope size would also perform the desired wiping action. The cords 24 may be connected to the net 26 by any suitable means such as tying each of the cords to a respective juncture point in the net 26. The floats 28 may be tied to the upper rim 30 of the net, also at respective juncture points with the netting. The net 26 may be constructed of any suitable negatively buoyant cord or rope material, such as manila, sizal, or hemp.

In the embodiment of the invention illustrated in FIGS. 1 and 2, there is a special advantage in the net 26 being floated free in the water about the hull of the ship 20. This advantage is the relative movement between the ship and the net which causes increased abrading action of the upper portions of the cords 24 on the bottom and side portions of the hull of the ship. This increased action works very well in cleaning and maintaining the hull of the ship free of marine organisms without any damage to the painted surfaces of the hull.

If desired, a rear portion of the net 26 may be separated at 32 for swinging the end of the net open so that the ship 20 can be driven into or out of the net in a particular location. When the door portion of the net is closed it can be retained in its position by connecting a pair of buoys 34 together by a line 36. It is to be understood that this is only an exemplary method of getting the net about the ship and that the invention encompasses other installation methods.

Figure 3:
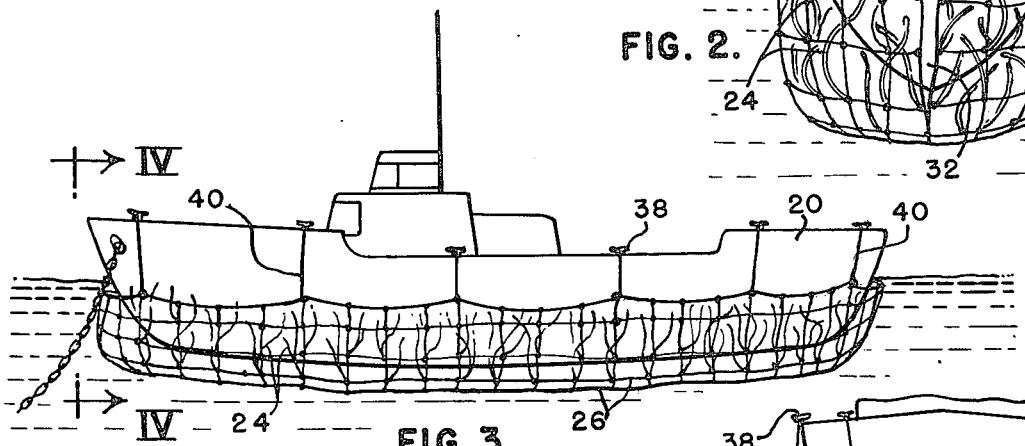
FIG. 3 is a side ocean elevational view of a ship being protected by another embodiment of the present invention.
Figure 4:
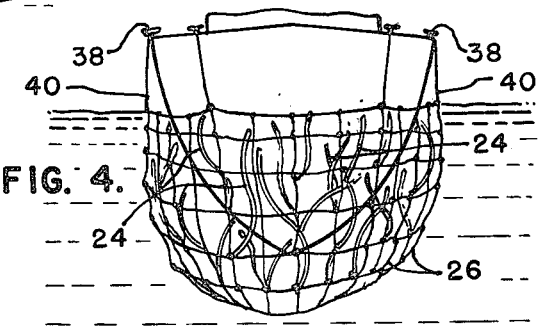
FIG. 4 is an ocean elevation view of the ship taken along plane IV—IV of FIG. 3.

Another embodiment of the present invention is illustrated in FIGS. 3 and 4. This embodiment is identical to the invention illustrated in FIGS. 1 and 2, except the net 26 is tied off about the ship, such as at cleats 38 by lines 40 and the net is not separated at one end. The lines 40 may be tied at their other ends to the rim 30 of the net and respective juncture points with the netting. The positively buoyant cords 24 will perform a wiping action on the hull of the ship similar to the cords 24 illustrated in FIGS. 1 and 2 except the cords in FIGS. 3 and 4 do not perform as vigorous a wiping action since there is less relative movement between the net and the ship. The advantage of this embodiment, however, is that a separated portion of the net is not necessary for entrance and exit of the ship within the net. The net 26 of the FIGS. 3 and 4 embodiment may simply be dropped in total at the bow or stern of the ship and pulled along by the crew under the ship until the bottom hull portion of this ship is completely protected. This advantage is especially useful when the ship is traveling from port to port and is repeatedly installing and removing the net.

Figure 5:
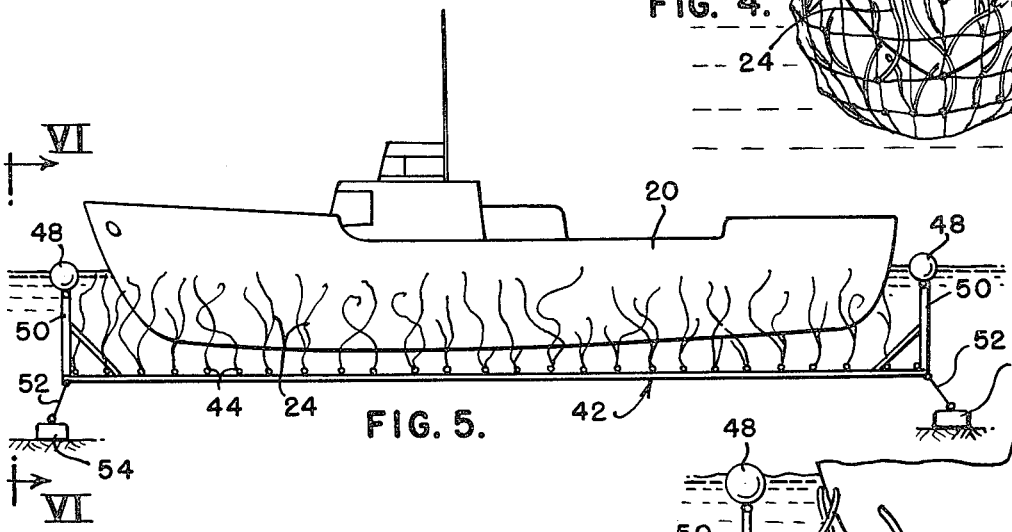
FIG. 5 is an in port elevation view of a ship being protected by still another embodiment of the present invention.
Figure 6:
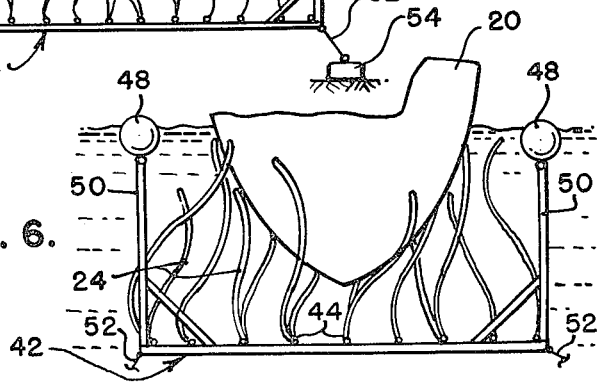
FIG. 6 is an ocean elevational view of the boat taken along VI—VI of FIG. 5.

Still another embodiment of the present invention is illustrated in FIGS. 5 and 6. In this embodiment a negatively buoyant underwater support, such as a framework 42, may be employed. The framework 42 may be a plurality of criss-crossed bars 44 constructed of any suitable negatively buoyant material such as plastic or steel. The framework 42 may be positioned below the hull of a waterborne object, such as the ship 20, by any suitable means, such as floats 48. The floats 48 may be connected to respective peripheral locations of the framework 42 by any suitable means such as lines, or upstanding rods 50. The framework 42 may be maintained stationary in the water by any suitable means such as underwater mooring lines 52 which are connected to respective clumps 54. Alternatively, the framework 42 may be maintained in position under the ship 20 by lines (not shown) which connect the floats 48 to respective points about the ship. At least one buoyant cord, and preferably a plurality of the buoyant cords 24, are tied to the framework 42, such as at respective juncture points of the bars 44. The cords are tied in many locations so as to ensure overlapping wiping action on the bottom and side portions of the ship's hull. The advantage of this particular embodiment is that it is especially useful for marinas where the entire assembly can be maintained stationary in the water while a boat is repeatedly driven into or out of the assembly. In order to prevent entanglement of the cords 24 in the propeller of the boat, the boat should always be manually pulled into or out from the docking apparatus with its motor off. Alternatively, the same advantages of this embodiment may be obtained by typing one or a plurality of such cords 24 to respective clumps (not shown) at spaced locations on the bottom of the water area so as to completely protect the hull portions of the boat.

Figure 7:
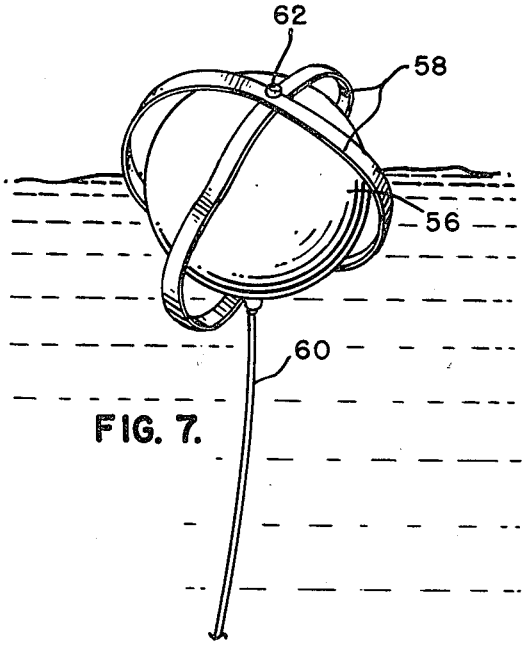
FIG. 7 is an ocean elevational view of a buoy being protected by a further embodiment of the present invention.

Another embodiment of the invention is illustrated in FIG. 7. In this embodiment, a buoy, such as a spherical buoy 56, is protected by a cord and preferably a pair of cords 58. The buoy may be moored to the bottom by a line 60. The cords 58 may be either positively or negatively buoyant and may be ribbon shaped as illustrated in the figure. Means, such as pins 62 (only the top pin being illustrated in the figure) are utilized for pivotally connecting the cords in a looped fashion about the buoy 56 at a pair of oppositely located positions, preferably the top and bottom locations of the buoy. Each pin 62 extends through both cords thence into the buoy 56, and may have enlarged outer portions to prevent the cords from slipping off the pins. Each cord may be a continuous loop or connected to itself at the juncture of one of the pins 62. The loop area of each cord should be slightly larger than the diameter of the buoy 56 so that water motion will cause each cord to swing across and abrade the surface of the buoy to keep it clean of marine growth. A buoy utilizing a pair of such cords has been found to be kept completely free of any marine growth, however more cords could be employed in the same manner as desired.

Figure 8:
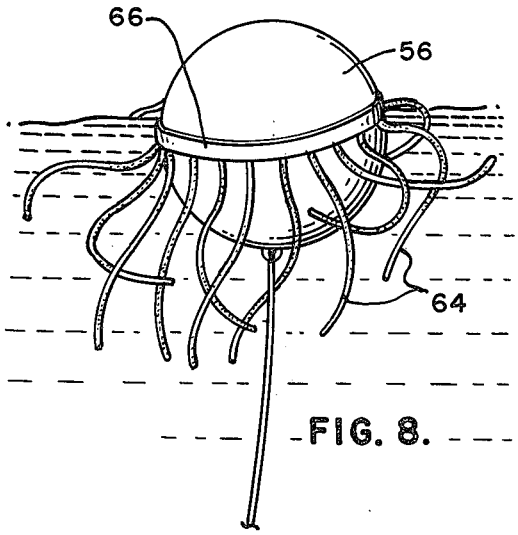
FIG. 8 is an ocean elevational view of a buoy being protected from marine growth by another embodiment of the present invention.

Another embodiment of the present invention is illustrated in FIG. 8. In this embodiment a spherical buoy 56 may be protected from marine growth by a plurality of negatively buoyant cords 64 which are affixed at various locations about a ring 66. The ring 66 may be of such a size as to slip over the top of the buoy 56 and circumvent the buoy near the waterline. The ring 66, which may be made of plastic, may be force fitted onto the buoy 56 or otherwise retained thereto by any suitable means such as clamps (not shown). Since the cords 64 are negatively buoyant they should be constructed of suitable material, such as manila, hemp, or jute. Water action, such as waves and current will cause the cords 64 to continuously abrade the sides and bottom of buoy 56 to maintain it completely free of marine growth.

Figure 9:
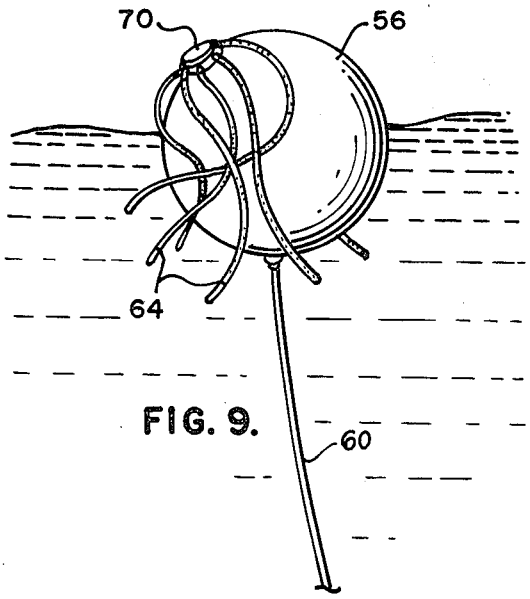
FIG. 9 is an ocean elevational view of a buoy being protected from marine growth by still another embodiment of the present invention.
Figure 10:
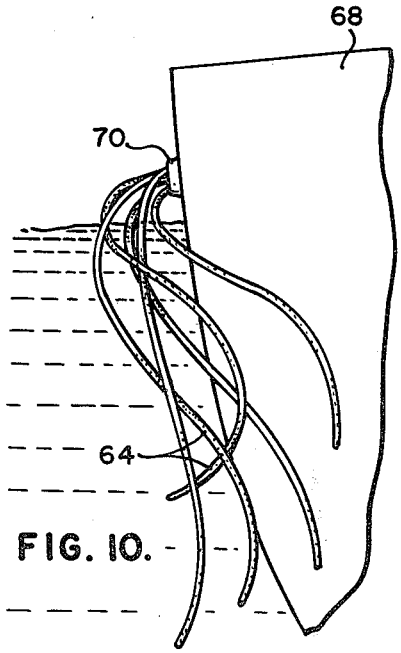
FIG. 10 is an ocean elevational view of a portion of a side of a ship being protected from marine growth by the same embodiment of the present invention as illustrated in FIG. 9.

Another embodiment of the present invention is illustrated in FIGS. 9 and 10. FIG. 9 illustrates a buoy 56 being protected from marine growth while FIG. 10 illustrates a side portion of a ship or boat 68 being protected from marine growth. Both figures show a plurality of negatively buoyant cords 64 connected at a common location by any suitable means such as a suction cup 70. The suction cup 70, which may be constructed of rubber, may be simply pressed onto a portion of the buoy 56 or boat 68 above the waterline so that the cords 64 dangle below the waterline to remove marine growth therefrom. The cords 64 may be connected to the suction cup by any suitable means such as bonding with epoxy resin. If desired, a plurality of such suction cups with their respective cords 64 may be positioned about a boat 68 so as to keep the side and bottom hull portions of a boat completely free of the marine growth.

Figure 11:
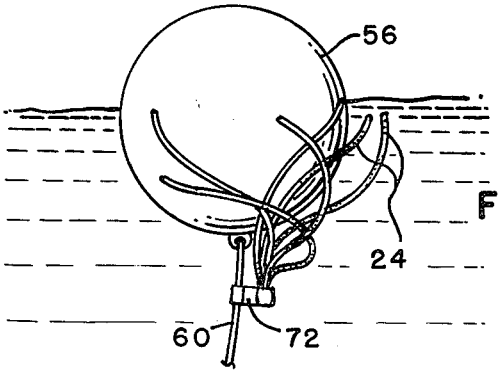
FIG. 11 is an ocean elevational view of a buoy being protected from marine growth by yet another embodiment of the present invention.

Another embodiment of the present invention is illustrated in FIG. 11. In this embodiment a buoy 56 may be kept free of marine growth by a plurality of positively buoyant cords 24 which may be connected to the buoy 56 by a clamp 72. The clamp 72 may be attached to the mooring line 60 of the buoy and may be of the type that is affixed securely to the line so as to prevent any sliding therealong. With this arrangement the positioning of the cords 24 below the buoy 56 may be such that the water action causes the cords to completely wipe the buoy free of marine growth.

It is to be understood that the cords in all of the embodiments may be tied or secured to the positioning means at one of their bitter ends so that the opposite bitter ends are involved in abrading action, or alternatively, the cords can be tied intermediate their ends so that both of the bitter ends of each respective cord is involved in abrading the waterborne object to remove marine growth.

In a method of the present invention marine growth may be wiped from a waterborne object by providing a plurality of positively buoyant cords, positioning these cords below the waterborne object so that the cords are capable of wiping across the bottom of the object, and floating the cords free in the water so that water movement will activate the cords to wipe across the object and remove the marine growth therefrom. Additionally, the cords may be positioned below the object in a transverse spaced relationship. Another method of the present invention may include providing a plurality of negatively buoyant cords, affixing the cords to the waterborne object at a common location so as to form a tassel, and suspending the cords free in the water so that water movement will activate the cords to wipe across the object.

Obviously, many modifications and variations of the present invention are possible in the light of the above teachings, and, it is therefore understood the invention may be practiced otherwise than as specifically described.

What is claimed is:

1. A marine growth wiper for a waterborne object comprising:

a plurality of cords which are limp;

negatively buoyant underwater support means for positioning the cords below the waterline and within wiping distance of a submerged surface area of the waterborne object; and said cords being positively buoyant so as to stream upwardly from the underwater support means and move responsively to water action to wipe the bottom of the object free of marine growth.

2. A marine growth wiper as claimed in claim 1 including:

said underwater support being a net.

3. A marine growth wiper as claimed in claim 2 including:

said net being attached to and encompassing the bottom submerged portion of the waterborne object.

4. A marine growth wiper as claimed in claim 2 including:

float means connected to the net for suspending the net free in the water about the waterborne object.

5. A marine growth wiper as claimed in claim 1 including:

said underwater support being a framework.

6. A marine growth wiper as claimed in claim 5 including:

float means suspending the framework off the bottom of the water; and means anchoring the framework in a predetermined suspended location.

7. A marine growth wiper for a waterborne spherical buoy comprising:

at least one cord which is limp;

said cord being joined at its opposite ends to form a closed loop; and means pivotally connecting the looped cord to the spherical buoy at top and bottom locations so that a portion of the cord is located below the waterline and within wiping distance of a submerged surface area of the waterborne spherical buoy, whereby water movement will cause the cord to wipe across said submerged surface area to remove marine growth therefrom.

8. A method of wiping marine growth from a waterborne object comprising the steps of:

providing a plurality of positively buoyant cords which are limp;

positioning the cords below the object so that the cords are capable of wiping across the bottom of the object; and floating the cords free in the water so that water movement will activate the cords to wipe across said object.

9. A method of wiping marine growth as claimed in claim 8 including:

positioning the cords below the object in a transverse spaced relationship.

10. A method of wiping marine growth from a waterborne object where there is some water movement comprising the steps of:

providing a negatively buoyant net;

affixing a plurality of positively buoyant limp cords to the net in a spaced relationship;

positioning the net in the water below the waterborne object so that the cords will wipe across the bottom of the object; and floating the cords free in the water so that the water movement will activate the cords to wipe across the object to free the object of marine growth.

11. A method as claimed in claim 10 including:

said positioning being accomplished by the step of attaching floats to the net so that the net is suspended free in the water.

12. A method as claimed in claim 10 including:

said positioning being accomplished by tying the net to the waterborne object.

13. A method of wiping marine growth from a boat in water where is some water movement comprising the steps of:

providing a negatively buoyant framework;

affixing a plurality of positively buoyant limp cords to the framework in a spaced relationship;

positioning the framework in the water below the boat so that the cords will wipe across the side and bottom hull portions of the boat; and floating the cords free in the water so that the water movement will activate the cords to wipe across the side and bottom hull portions to free the boat of marine growth.

14. A method as claimed in claim 13 including:

said positioning being accomplished by the steps of attaching floats to the framework to float the framework in the water and anchoring the framework to the bottom of the water.

15. A method of wiping marine growth from a waterborne spherical buoy where there is some water movement comprising the steps of:

positioning a limp cord circumferentially about the buoy in a substantially vertically oriented loop;

affixing the top and bottom of the looped cord to the top and bottom respectively of the buoy; and making the area of the looped cord larger than the cross-sectional area of the buoy, but small enough to wipe across the submerged portion of the buoy when there is water movement, whereby water movement will free the buoy from marine growth.

16. A method as claimed in claim 15 including:

said affixing is accomplished by the step of pivotally connecting the top and bottom of the looped cord to the top and bottom respectively of the buoy.

* * * * *